US005794856A

United States Patent [19]

Nally

[11] Patent Number: 5,794,856

[45] Date of Patent: Aug. 18, 1998

[54] AIR ASSIST INJECTOR AND RETAINER SHROUD THEREFOR

[75] Inventor: Debora E. Nally, Williamsburg, Va.

[73] Assignee: Siemens Automotive Corporation, Auburn Hills, Mich.

[21] Appl. No.: 843,549

[22] Filed: Apr. 18, 1997

Related U.S. Application Data

[63] Continuation-in-part of Ser. No. 444,496, May 19, 1995, abandoned.

[51] Int. Cl.[6] ..... B05B 7/12

[52] U.S. Cl. ..... 239/408; 239/417.3; 239/585.4

[58] Field of Search ..... 239/417.3, 408, 239/423, 585.1–585.5, 533.3–533.12, 600

[56] References Cited

U.S. PATENT DOCUMENTS

| | | | |
|---|---|---|---|
| 5,046,472 | 9/1991 | Linder | 239/585.4 X |
| 5,218,943 | 6/1993 | Takeda et al. . | |
| 5,238,192 | 8/1993 | McNair . | |
| 5,323,960 | 6/1994 | Buchholz et al. | 239/585.4 X |

FOREIGN PATENT DOCUMENTS

| | | | |
|---|---|---|---|
| 60-6065 | 1/1985 | Japan | 239/585.4 |
| 2130257 | 5/1990 | Japan | 239/585.5 |

*Primary Examiner*—Kevin Weldon
*Attorney, Agent, or Firm*—Russel C. Wells

[57] ABSTRACT

An air assist top feed fuel injector having a nozzle end for delivering fuel to an engine induction passage includes a retainer shroud on the injector nozzle end for directing air adjacent the nozzle end for atomizing the fuel. In a preferred embodiment, the retainer shroud is an integral member including an interconnected end cap, a central seal retainer and a connecting sleeve between the cap and retainer. The member directs assist air around the nozzle to atomize the fuel and retains lower and central seal rings that prevent leakage from or into the air passages. Alternative embodiments include separate end cap, upper ring retainer and lower ring retainer members or integral upper and lower retainer members that coact to similarly direct and prevent leakage of assist air.

3 Claims, 2 Drawing Sheets

AIR ASSIST INJECTOR AND RETAINER SHROUD THEREFOR

This is a continuation-in-part of application Ser. No. 08/444,496 Filed May 19, 1995 now abandoned.

FIELD OF THE INVENTION

This invention relates to solenoid operated top feed fuel injectors for internal combustion engines and more particularly to retainer shrouds for delivering supplemental air through such injectors.

BACKGROUND OF THE INVENTION

Typically, air assist injectors have at least three exterior O-ring sealing surfaces. A top O-ring seals the injector to the fuel rail. A central O-ring seals the injector to the engine inlet manifold, or cylinder head, above the air assist flow passages. A lower O-ring seals the injector to the manifold or head below the air assist flow passages.

Previously the central O-ring seal has been retained by the creation of a machined surface in the valve body. However, this requires modification of the standard body used for non-air assisted injectors and increases cost as well as requiring additional inventory and handling considerations.

The lower O-ring seal has been retained in a shroud attached to the lower section of the valve body. Typically the lower end of the valve body has been machined flat on two sides of the outer diameter to allow air to pass between the shroud and the valve body through the space created by the flats. Retention of the shroud attachment is accomplished on the round non-modified section of the outer diameter.

While some shroud-like attachments have been proposed for air assist injector air delivery which retain both the lower and central seal rings sealing the air passages, these have typically been mounted around the injector tip and extended beyond it, resulting in recessing of the injection nozzle in the manifold.

SUMMARY OF THE INVENTION

The present invention provides improved retainer shroud arrangements in which both the lower and central seal rings for sealing the air passages in an air assist injector manifold mounting may be retained by one or more preferably plastic insert members, at least the upper portion of which is retained to or forms part of an over-molded plastic housing of the injector body. Additionally, the lower portion of the shroud surrounding the lower end of the injector nozzle has a radially extending wall which lies immediately below the injection nozzle, allowing the nozzle to extend close to the air passage into which the air assisted fuel mixture is to be delivered. If desired, an extension of the mixture passages could be formed as a part of or attached to the radial wall allowing protrusion of the injector spray tip into the air stream below the injector mounting.

These and other features and advantages of the invention will be more fully understood from the following description of certain exemplary embodiments of the invention taken together with the accompanying drawings.

DETAILED DESCRIPTION OF THE INVENTION

Figure 1:
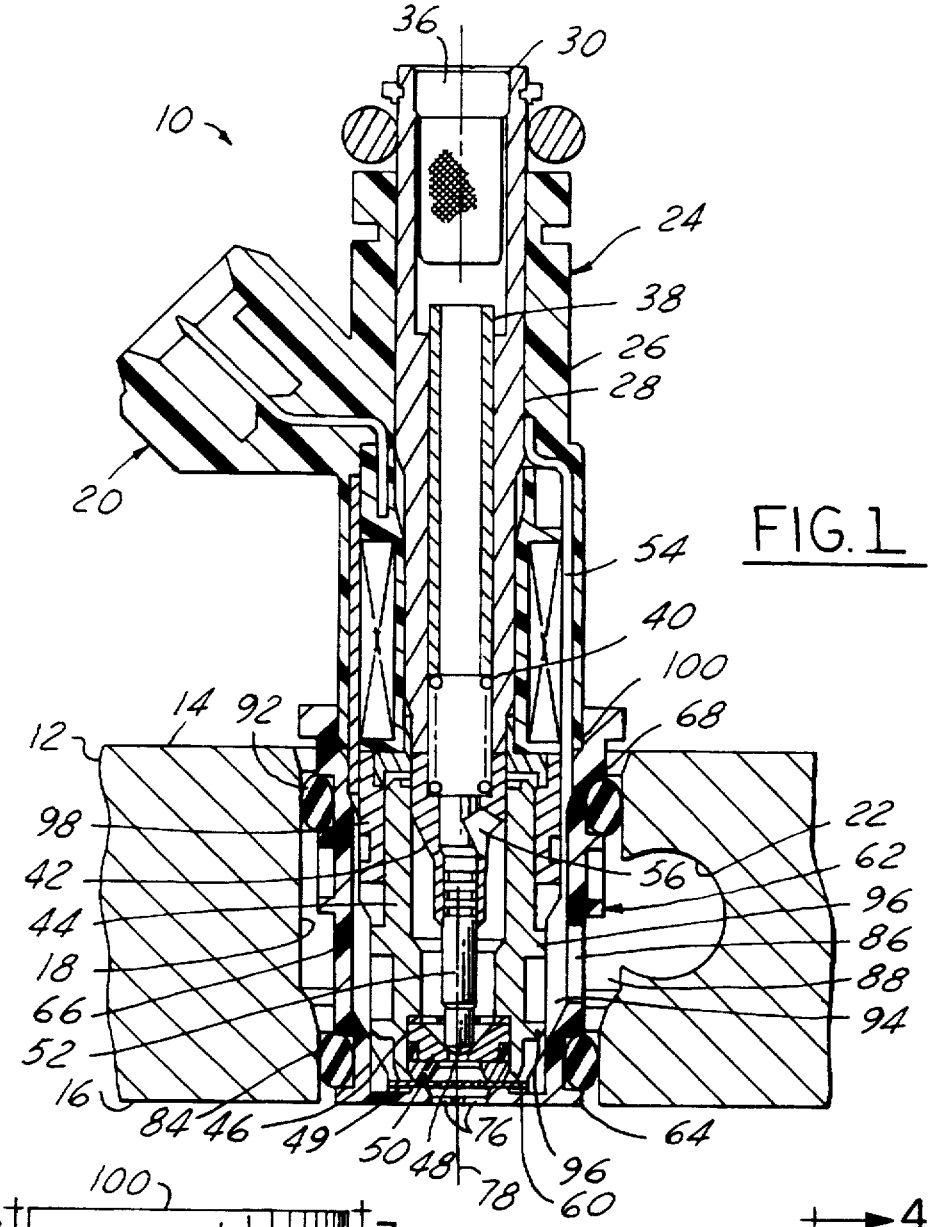
FIG. 1 is a cross-sectional view of a preferred embodiment of air assist top feed fuel injector according to the invention shown mounted in an engine cylinder head or manifold mounting surface.

Referring now to FIGS. 1–4 of the drawings in detail, numeral 10 generally indicates an internal combustion engine having an intake manifold or cylinder head 12 including an external wall surface 14 and an internal wall surface 16, the latter defining in part a passage for air induction into the engine cylinders, not shown. Between the surfaces 14, 16, a stepped bore opening 18 provides a socket for receiving an air assist injector generally indicated by numeral 20. An air passage 22 extending through the cylinder head intersects the opening 18 along one side thereof.

Injector 20 includes a body 24 of the type used for conventional non-air assist top feed fuel injectors. Body 24 includes an over-molded plastic housing 26 surrounding an inlet tube 28 that extends from an outer axial end 30 of the injector to an intermediate location near the lower end of the housing 26 and approximately adjacent the plane of the external wall surface 14. An upper O-ring seal 32 is provided to sealingly connect the inlet tube within a retainer cup of a connected fuel supply rail, not shown.

Within the inlet tube 28, an inlet filter 36 is conventionally mounted adjacent the outer end of the tube to remove impurities from incoming fuel. Centrally of the tube 28, an adjusting tube 38 is positioned in engagement with a spring 40 that extends beyond the tube into a recess in an axially reciprocable armature 42. The armature 42 reciprocates within a valve body 44 which extends below the housing 26 and supports at this lower end a valve seat 46 having a central orifice 48 and outwardly retained by a metering air disk 49 and a backup washer 50. A valve needle 52 is fixed in assembly with the armature 42 and has a lower end which is normally biased into seating engagement with a conical surface of the valve seat 46 by the action of the spring 40 against the armature. The needle 52 may be guided by a perforate needle guide 53 positioned between the valve seat and valve housing.

An externally energized electrical coil 54 within the lower end of the housing 26 is positioned to attract the armature 42 so as to move the valve needle 52 away from its seat 46 against the bias of spring 40 when the coil is energized. This allows fuel to flow through the injector from the inlet end through filter 36 and adjusting tube 38 past the spring 40 and through an opening 56 in the armature 42 around the valve needle 52, through needle guide 53, past valve seat 46 and through the orifice 48 and adjoining openings in the air disk 49 and backup washer 50. A connector 58 on the housing 26 provides means for connecting an external electronic control means, not shown, with the coil 54 for actuating the coil when desired.

Figure 2:
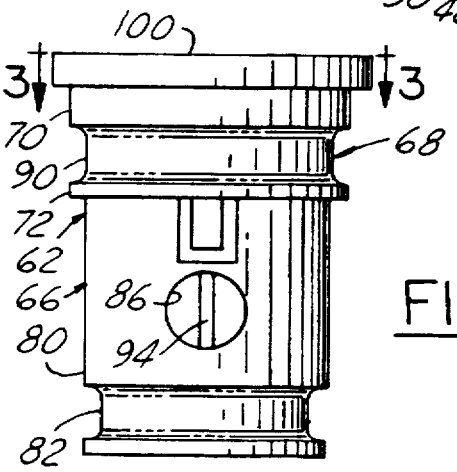
FIG. 2 is a side view of the integral retainer shroud of the injector of FIG. 1.
Figure 3:
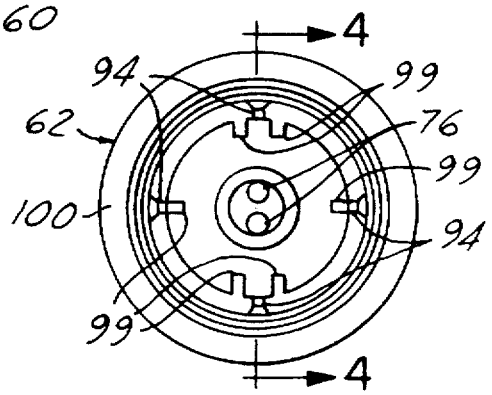
FIG. 3 is a upper end view of the retainer shroud of from the plane of line 3—3 of FIG. 2.
Figure 4:
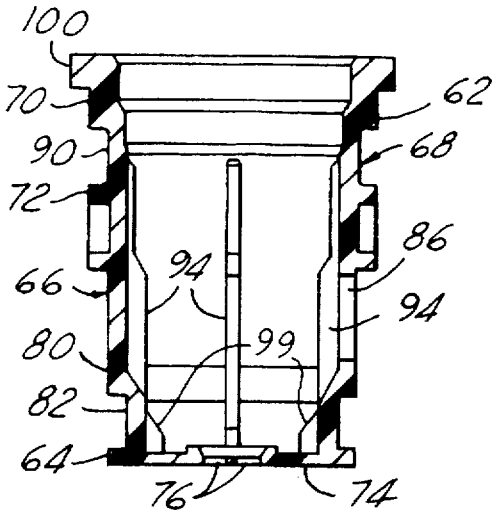
FIG. 4 is a longitudinal cross-sectional view of the retainer shroud from the plane of line 4—4 of FIG. 3.

In order to provide air assist for atomizing the fuel delivered through the orifice 48 by the injector, the lower end 60 of the injector body is surrounded by a retainer shroud 62, formed in accordance with the invention and best shown in FIGS. 2–4. While the retainer shroud is an integral member, it is made up essentially of three identifiable portions: namely, end cap 64 intermediate sleeve 66 and central seal retainer 68, the latter including upper and lower retainer portions 70, 72 respectively.

The end cap 64 includes a radial end wall 74 having at least one and, in the illustrated embodiment, two outlet openings 76. The outlet openings 76 extend through a central portion of the end wall 74 generally in line with or spaced closely adjacent to the longitudinal axis 78 of the injector. The end cap further includes a cylindrical wall 80 extending axially inward (upward in the drawings) from the end wall 74 and including an external angular groove 82 for retaining an annular seal ring 84 thereon as shown in FIG. 1.

The sleeve 66 comprises an extension of the cylindrical wall 80 further inward from the cylindrical wall. It includes at least one radial inlet opening 86 extending through the sleeve intermediate its ends for admitting air from the air passage 22 in the cylinder head 12 via an annular chamber 88 defined between the sleeve 66 and the interior wall of the opening 18 in which the injector is mounted.

The central seal retain 68 connects axially inwardly with the sleeve 66 and and includes an external annular groove 90 defined between the upper retainer portion 70 and the lower retainer portion 72 which provide annular abutments or flanges for retaining a central seal ring 92 as shown in FIG. 1.

The retainer shroud 62 is received over the nozzle end of the injector body 24 and further includes four circumferentially spaced internal ribs 94 extending longitudinally along the inner wall of the sleeve 66. The ribs 94 have deeper lower portions for guiding the retainer shroud on annular flanges 96 of the valve body lower end and shallower upper portions for guiding on an enlarged diameter of the valve body shell 98. Additional ribs 99 are located near the end wall 74 to center and locate the air disk 49.

To retain the shroud 62 on the injector end, the preferably plastic member 62 may be ultrasonically welded to the over-molded housing 26 of the injector body, near the location of an upper flange 100 formed on the central seal retainer 68 and extending around the lower end of the housing 26. However, other forms of welding including adhesive bonding or the like may also be used and are intended to be encompassed by the term welding as used in the claims.

The ribs 94 maintain an annular space between the valve body 44 and the sleeve 66 for delivering air from the inlet opening 86 axially to the metering air disk 49 and then radially inward across the air disk to a central opening therein adjacent the backup washer 50 of the nozzle assembly. There it mixes centrally with fuel delivered through the orifice 48 when the needle valve is opened and provides an atomized mixture which is delivered through the outlet opening(s) 76 in the end wall to the connecting air induction passage defined by the internal wall surface 16 of the cylinder head 12.

Figure 5:
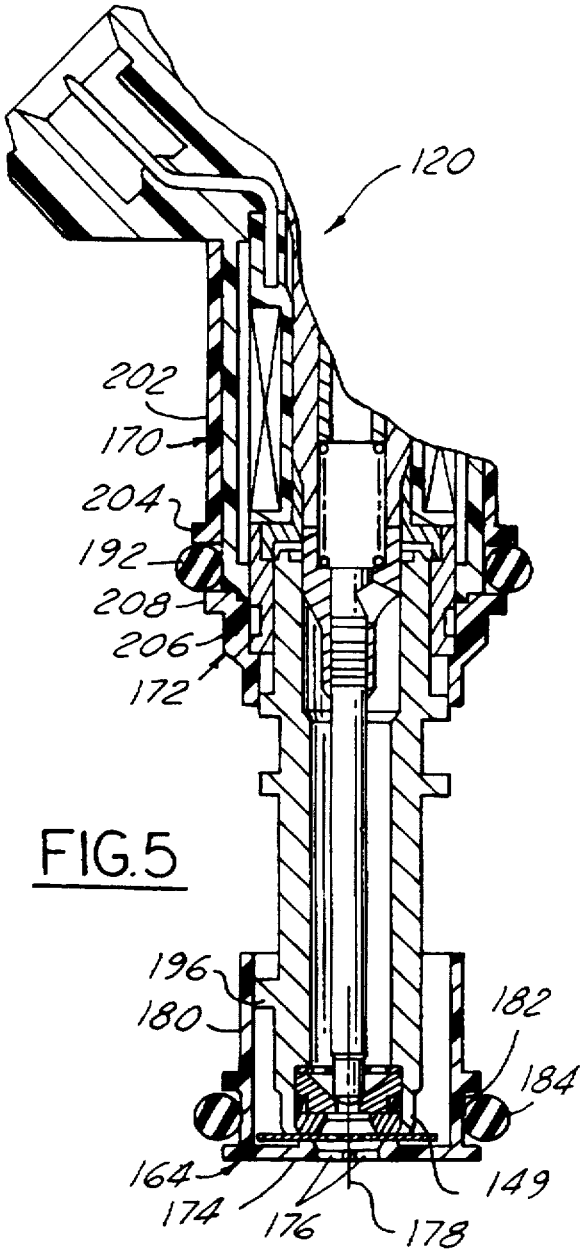
FIG. 5 is a longitudinal cross-sectional view of an air assist injector having an alternative embodiment of retainer shroud means according to the invention.

Referring now to FIG. 5 of the drawings, there is shown an alternative embodiment of injector 120 according to the invention. Because the details of the injector body are similar to those of the first described embodiment, similarly ending numerals are used for like parts and further description of the injector body is believed unnecessary.

The embodiment of FIG. 5 differs from that of FIGS. 1–4 in the configuration and construction of the retainer shroud which in this instance is made up of three separate elements: namely, an end cap 164 and a central seal retainer comprising an upper retainer 170 and a lower retainer 172. As before, the end cap 164 includes a radial end wall 174 and one or more generally centralized outlet openings 176 centered on or near the injector axis 178 and below a metering air disk 149. A cylindrical wall 180 extends upward from end wall 174 and defines an annular groove 182 for retaining an annular seal ring or O-ring 184. The wall 180 is guided on one or both of the annular flanges 196 of the valve body, portions of which may be cut away to provide longitudinal air passages extending from an open upper end of the cylindrical wall 180 to the air disk 149 and inwardly to the outlet opening 176.

In the present instance, the central seal retainer includes an upper retainer 170 including a sleeve 202 which is received over the injector housing 26. The sleeve contacts the connector 58 and is retained by a press fit, welding or other means. At its lower end, sleeve 202 connects with a radial flange 204 which defines the upper side of a groove for receiving the central O-ring 192. The lower retainer 172 includes a plastic shell 206 on the upper end of which is formed a radial flange 208 that forms the lower side of the ring groove for O-ring 192. The shell 206 is preferably snapped into place on the housing but may be otherwise attached if desired.

Together the end cap 164, upper retainer 170 and lower retainer 172 comprise, and carry out the functions, of the retainer shroud of FIG. 1 but without the connecting sleeve found in the first described embodiment. If desired, the end cap 164 may be formed with internal ribs for spacing the cylindrical wall 180 outwardly from the flanges 96 of the conventional valve body so that modification of the valve body is not required for use in an air assist injector.

Figure 6:
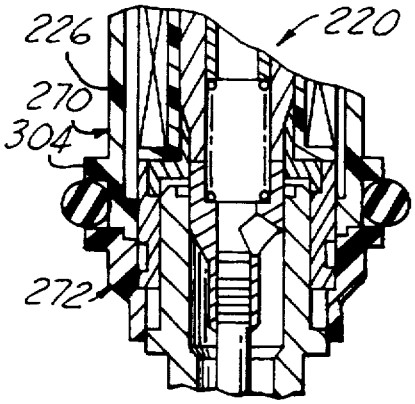
FIG. 6 is a fragmentary cross-sectional view similar to FIG. 5 but showing another embodiment.

FIG. 6 shows another embodiment of injector 220 similar to FIG. 5 except that the flange 304 of the upper retainer 270 is formed integral with the overmolded housing 226 while the lower retainer 272 is like retainer 172 of FIG. 5.

Figure 7:
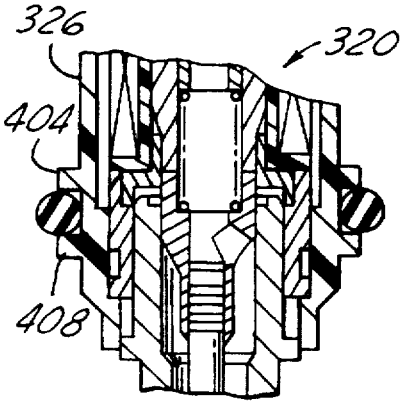
FIG. 7 is a view similar to FIG. 6 showing still another embodiment.

FIG. 7 illustrates another embodiment of injector 320 wherein both flange 404 of the upper retainer 370 and flange 408 of the lower retainer 372 are formed as integral portions of the overmolded housing 326.

The described embodiments provide examples of the application of the present invention to a conventional top feed fuel injector to fit it for air assist operation by mounting within a socket or opening in an engine inlet manifold or cylinder head wall having an air feed passage. The described embodiments have the advantage that the standard top feed injector body needs little or no modification in order to be used in the air assist assembly mode, thereby reducing both the cost and complexity of manufacturing air assist injectors on facilities already provided for manufacturing conventional top feed injectors without air assist.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An air assist top feed fuel injector comprising a body having at a first axial end a fuel inlet tube through which fuel is introduced into a fuel passage that extends through said body to a nozzle at a second axial end of said body, electrically controlled valve mechanism for controlling fuel flow through said fuel passage, said mechanism having an armature including a valve member biased toward closing against a valve seat by a spring and openable by electric actuation of the armature, and a retainer shroud, said injector characterized in that:

said retainer shroud is a tubular-like member having a central bore along a longitudinal axis with a first open end and a second end, a plurality of stepped diameters extending from said first open end, an end cap enclosing said second end, a central seal retainer and a connecting sleeve between said end cap and said retainer;

said first open end having a chamfer means around said central bore;

said end cap including at least one outlet opening therethrough and said connecting sleeve including an external annular groove for retaining an annular seal ring therein;

said connecting sleeve including a radial inlet opening intermediate its ends for admitting air from an external source;

said central seal retainer connecting axially with said sleeve for retaining another annular seal ring therein;

a plurality of equally spaced longitudinally extending ribs axially along the inner wall of said sleeve;

a plurality of radially extending ribs along said end cap, said longitudinally and radially extending ribs forming an enclosed air passage around the body of the injector for delivering air from said radial inlet opening to said outlet opening for mixing with fuel delivered through said nozzle to said outlet opening; and said retainer shroud being positionable over the nozzle end of the body and sealingly retained to an intermediate portion thereof along said chamfer means.

2. A fuel injector as in claim 1 characterized in that the body includes an overmolded nonmetallic housing and said retainer shroud is sealingly welded to said housing along said chamfer means.

3. A fuel injector as in claim 2 wherein said end cap has at least one more outlet opening and said at least two outlets spaced closely adjacent to said longitudinal axis.

* * * * *